US007845358B2

(12) United States Patent
Danforth

(10) Patent No.: US 7,845,358 B2
(45) Date of Patent: Dec. 7, 2010

(54) METHOD FOR CONTROLLING, REDUCING, AND QUITTING SMOKING

(75) Inventor: Lewis James Danforth, Fort Atkinson, WI (US)

(73) Assignee: TLC Consulting, Inc., Pewaukee, WI (US)

( * ) Notice: Subject to any disclaimer, the term of this patent is extended or adjusted under 35 U.S.C. 154(b) by 681 days.

(21) Appl. No.: 11/799,868

(22) Filed: May 3, 2007

(65) Prior Publication Data

US 2008/0271744 A1 Nov. 6, 2008

(51) Int. Cl.
*A24F 47/00* (2006.01)

(52) U.S. Cl. ..... 131/272; 128/202.21

(58) Field of Classification Search ..... 131/272; 128/202.21

See application file for complete search history.

(56) References Cited

U.S. PATENT DOCUMENTS 2,721,551 A * 10/1955 Lobl ..... 128/202.21
2,764,154 A * 9/1956 Murai ..... 128/200.21
2,860,638 A * 11/1958 Bartolomeo ..... 128/202.21
3,200,819 A * 8/1965 Gilbert ..... 128/202.21
3,294,098 A * 12/1966 Gustafson ..... 131/184.1
3,521,643 A * 7/1970 Toth ..... 128/202.21
4,393,884 A * 7/1983 Jacobs ..... 131/273
5,666,977 A * 9/1997 Higgins et al. ..... 131/194
6,148,826 A * 11/2000 Lancaster et al. ..... 131/191
6,637,430 B1 * 10/2003 Voges et al. ..... 128/200.14
6,854,470 B1 * 2/2005 Pu ..... 131/273
2006/0118128 A1 * 6/2006 Hoffmann et al. ..... 131/271
2008/0241255 A1 * 10/2008 Rose et al. ..... 424/489

* cited by examiner

*Primary Examiner*—Carlos Lopez
(74) *Attorney, Agent, or Firm*—Richard S Missimer

(57) ABSTRACT

This invention is an improved method for controlling, reducing, and quitting smoking. Specifically, this method requires the use of one or more non-combustible devices that employ (at least) (A) a loading chamber for measuring the amount of combustible material to be smoked; and (B) a baffle or similar apparatus to prevent the smoker from inhaling the tobacco. By using one such non-combustible device, the smoker can measure the precise amount of tobacco to be smoked. Hence, the smoker can reduce his or her dependency on smoking by limiting the amount of tobacco smoked, as well as how many times he or she smokes that amount each day. By using two or more non-combustible devices with varying loading chamber lengths, the smoker can reduce his or her dependency by gradually reducing the amount of tobacco smoked, in addition to how many times he or she smokes a day.

2 Claims, 2 Drawing Sheets

METHOD FOR CONTROLLING, REDUCING, AND QUITTING SMOKING

CROSS REFERENCE TO RELATED APPLICATION

This inventor claims priority from a U.S. design patent application Ser. No. 29/207,888 filed Jun. 19, 2004.

FIELD OF THE INVENTION

This invention is an improved method for controlling, reducing, and quitting smoking; specifically, it employs one or more non-combustible devices to limit and gradually reduce the amount of combustible material smoked.

DISCUSSION OF THE PRIOR ART

In 2003, the Centers for Disease Control and Prevention estimated that approximately 25.5 million men and 21.5 million women smoke. In other words, 24.1% of all men and 19.2% of all women are smokers. There are many reasons people start smoking, including, but not limited to, stress, life problems, peer pressure, family history, and personality tendencies. There are also many reasons people may want to quit smoking, including, but not limited to, health problems (such as lung cancer); and the smell, stained teeth, bad breath, wrinkled skin, and yellow nails associated with smoking. Moreover, smoking can cause the average male to lose 13.2 years of his life, and the average female to lose 14.5 years of her life.

People have invented many ways to quit smoking. U.S. Pat. No. 6,845,777 to Pera (2005) employs a composition that can take a capsule, powder, or liquid form, and that satisfies a smoker's craving for nicotine. U.S. Pat. No. 6,596,740 to Jones (2003) satisfies a smoker's craving for nicotine via a nasal spray. Other "quit smoking" inventions include, but are not limited to, adult pacifiers (i.e., U.S. Pat. No. 6,458,159 to Peters-Combs (2002)); cigarette aeration and filtration devices (i.e., U.S. Pat. No. 5,954,061 (1999)); wristwatches (i.e., U.S. Pat. No. 6,305,939 to Krstulovic (2001)); spinal cord stimulation (i.e., U.S. Pat. No. 6,233,488 to Hess (2001)); and chemotherapy (i.e., U.S. Pat. No. 6,333,357 to Eig (2001)). There is even a cigarette pack that plays an anti-smoking message each time the smoker opens it (U.S. Pat. No. 6,559,768 to Schaffner, et al. (2003)).

Despite all the creative ways people have tried to quit smoking, a study by the American Cancer Society in 2005 shows that only 2.5% of smokers who try to quit smoking each year actually succeed. Clearly, we still need more ways to quit smoking; for, not every method will work for each individual smoker.

None of the above inventions and patents, taken singly or in combination, is seen to describe the instant invention as claimed.

BACKGROUND OF THE INVENTION

The instant invention is an improved method of controlling, reducing, and quitting smoking. Specifically, it employs one or more non-combustible devices to limit and gradually reduce the amount of tobacco smoked. The instant invention also allows the smoker to limit the number of times he or she smokes a measured amount of tobacco each day.

Limiting and gradually reducing the amount of combustible material smoked will reduce the chances of the smoker developing either health problems, like lung cancer; or the smell, stained teeth, bad breath, wrinkled skin, and yellow nails associated with smoking. Limiting and gradually reducing the amount of tobacco smoked will also add years to the smoker's life. And, if the smoker eventually quits smoking, the afore-mentioned benefits will increase many-fold.

Further objects and advantages of the invention will become apparent from a consideration of the drawings and ensuing description.

BRIEF SUMMARY OF INVENTION

This method requires the use of a non-combustible device that comprises, at least, (A) a loading chamber for measuring the amount of tobacco to be smoked; and (B) a baffle or similar apparatus to prevent the smoker from inhaling the tobacco. U.S. Pat. No. 6,148,826 to Lancaster, et al. (2000) is an example of such a non-combustible device. Giving this example, however, is not intended to limit the instant invention to this example.

If the smoker chooses to use one non-combustible device, he or she can use the loading chamber to measure the precise amount of tobacco to be smoked. This way, the smoker can reduce his or her dependency by limiting the amount of tobacco smoked, as well as the number of times that amount of material is smoked each day.

If the smoker chooses to employ more than one non-combustible device, he or she must ensure that the loading chamber length of each subsequent non-combustible device used is shorter than the last non-combustible device's loading chamber length. Then, the smoker can gradually reduce the amount of tobacco smoked.

DRAWINGS

Reference Numerals

100—Non-combustible device
101—Rearward smoking chamber
102—Baffle
103—Forward loading chamber

DETAILED DESCRIPTION AND PREFERRED EMBODIMENT

Figure 1:
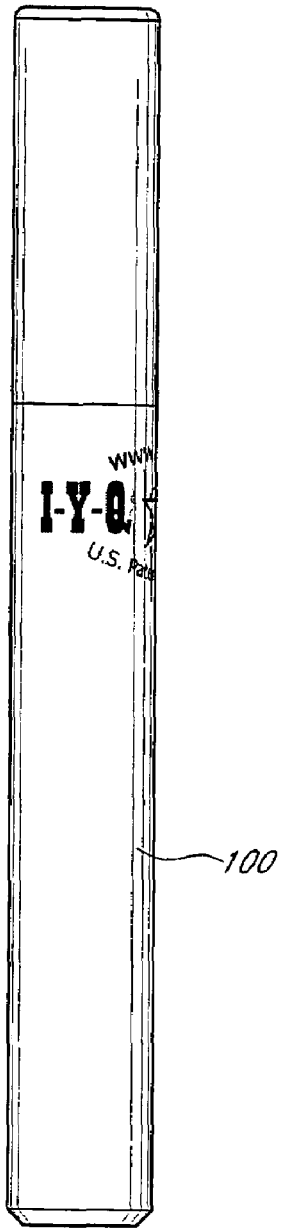
FIG. 1 is a perspective view of the non-combustible device.
Figure 2:
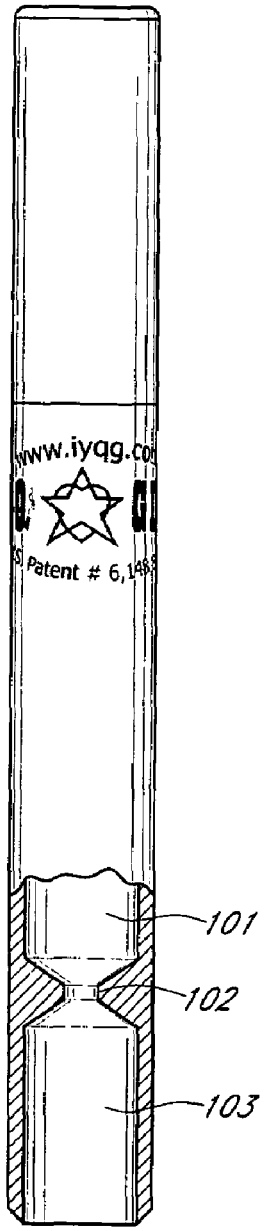
FIG. 2 is a partial sectional view of the non-combustible device having a large-sized loading chamber.
Figure 3:
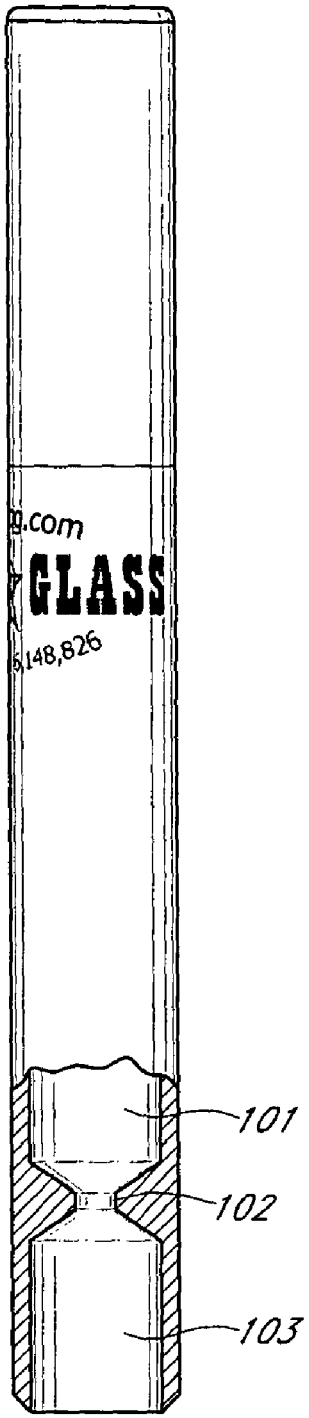
FIG. 3 is a partial sectional view of the non-combustible device having a medium-sized loading chamber.
Figure 4:
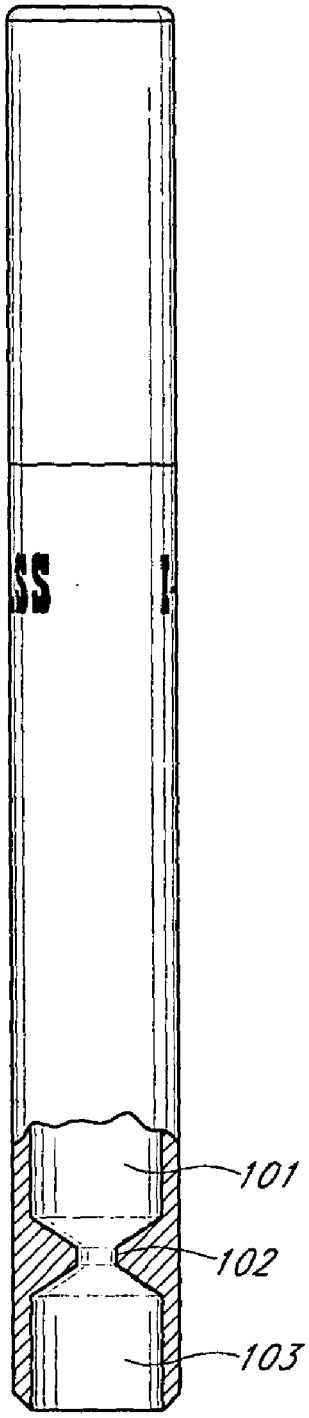
FIG. 4 is a partial sectional view of the non-combustible device having a small-sized loading chamber.

Referring to FIG. 1, a preferred embodiment of a non-combustible device 100 is illustrated that relates to the improved method of controlling, reducing, and quitting smoking. FIGS. 2-4 show the major components of the non-combustible device 100, and include a rearward smoking chamber 101, a baffle 102, and a forward loading chamber 103. The forward loading chamber 103 can be made to different lengths thereby allowing a user to select a non-combustible device 100 that corresponds to his or her desired tobacco volume needs. FIGS. 2-4 also show examples of non-combustible devices 100 that contain forward loading chambers 103 of varying sizes. FIGS. 1-4 show only a few of the unlimited variations that are possible within the foregoing disclosure of the invention.

I claim:

1. A method of controlling, reducing, and quitting smoking by periodically reducing the chamber length of a non-combustible smoking device to reduce the amount of tobacco consumed, whereby the smoker can, at his or her own pace, gradually reduce the amount of tobacco he or she smokes, comprising the following stops:

a) providing a series of non-combustible smoking, devices, each device employing (i) a noncombustible tube, (ii) a non-combustible baffle to prevent the smoker from inhaling the combustible material, and (iii) a loading chamber for measuring the amount of tobacco to be smoked; each non-combustible smoking device of the series shall have a different fixed chamber length;

b) selecting the largest chamber length from said series of non-combustible smoking devices;

c) loading a limited amount of tobacco material into the non-combustible smoking device, that is limited by the fixed chamber length;

d) igniting the limited amount of tobacco material by external flame; and e) inhaling/smoking said limited amount of tobacco material until said limited amount of tobacco material is exhausted.

2. A method of controlling, reducing, and quitting smoking by periodically reducing the chamber length of a non-combustible smoking device of claim 1, further comprising the following step:

f), removing the largest chamber length non-combustible smoking device from the series.

* * * * *